US009032859B2

(12) United States Patent
Fox et al.

(10) Patent No.: US 9,032,859 B2
(45) Date of Patent: May 19, 2015

(54) HARMONIZED TURRET WITH MULTIPLE GIMBALED SUB-SYSTEMS

(71) Applicant: DRS Sustainment Systems, Inc., St. Louis, MO (US)

(72) Inventors: Michael T. Fox, St. Charles, MO (US); Michael C. Mareschal, O'Fallon, MO (US); Jeffery P. Bertram, Shrewsbury, MO (US); Jeffrey S. Folmer, Edwardsville, IL (US); Bruce E. Exely, St. Louis, MO (US)

(73) Assignee: DRS SUSTAINMENT SYSTEMS, INC., St. Louis, MO (US)

( * ) Notice: Subject to any disclaimer, the term of this patent is extended or adjusted under 35 U.S.C. 154(b) by 132 days.

(21) Appl. No.: 13/691,090

(22) Filed: Nov. 30, 2012

(65) Prior Publication Data

US 2015/0059567 A1 Mar. 5, 2015

Related U.S. Application Data

(60) Provisional application No. 61/565,176, filed on Nov. 30, 2011, provisional application No. 61/565,961, filed on Dec. 1, 2011.

(51) Int. Cl.

| | |
|---|---|
| ***F41G 1/00*** | (2006.01) |
| ***F41H 5/26*** | (2006.01) |
| ***F41G 3/06*** | (2006.01) |

(52) U.S. Cl.

CPC . *F41H 5/266* (2013.01); *F41G 3/06* (2013.01)

(58) Field of Classification Search

CPC ... F16M 11/12; F16M 11/18; F16M 11/2014; B66F 11/044; F41A 23/20; F41H 13/005

See application file for complete search history.

(56) References Cited

U.S. PATENT DOCUMENTS

| | | | | |
|---|---|---|---|---|
| 2,440,968 | A * | 5/1948 | Colbath et al. | 235/413 |
| 2,454,806 | A | 11/1948 | Kemmer et al. | |
| 2,628,535 | A * | 2/1953 | Jackson, Jr. et al. | 89/41.18 |
| 2,633,060 | A | 3/1953 | Topham et al. | |
| 2,660,793 | A * | 12/1953 | Holschuh et al. | 89/202 |
| 3,602,088 | A | 8/1971 | Spring | |
| 4,194,432 | A | 3/1980 | Conway et al. | |
| 4,583,444 | A | 4/1986 | Jackson | |
| 4,662,265 | A | 5/1987 | Becker et al. | |
| 4,760,770 | A | 8/1988 | Bagnall-Wild et al. | |
| 5,197,691 | A | 3/1993 | Amon et al. | |
| 5,353,680 | A | 10/1994 | Tiomkin et al. | |
| 5,720,090 | A * | 2/1998 | Dawson, Jr. | 29/40 |

(Continued)

FOREIGN PATENT DOCUMENTS

| | | |
|---|---|---|
| DE | 3307069 A1 | 9/1984 |
| DE | 3229819 C2 | 2/1985 |

(Continued)

*Primary Examiner* — Samir Abdosh

(74) *Attorney, Agent, or Firm* — Kilpatrick Townsend & Stockton LLP

(57) ABSTRACT

Multiple independently gimbaled devices, such as an electro-optical sensor and machine gun, are mounted to a rotating platform on a vehicle. The platform can rotate to prevent one device from blocking the other while aiming at an off-board location. A control system can harmonize the rotation of the device gimbals and rotating platform so that they remain pointed at the same location. The platform can be rotated to place a firing weapon downwind of a sensor or otherwise compensate for effects of one on the other.

20 Claims, 10 Drawing Sheets

(56) References Cited

U.S. PATENT DOCUMENTS

| | | | | |
|---|---|---|---|---|
| 5,974,643 | A * | 11/1999 | Hays et al. | 29/39 |
| 6,396,235 | B1 | 5/2002 | Ellington et al. | |
| 6,442,815 | B1 * | 9/2002 | Moon et al. | 29/40 |
| 7,624,670 | B2 * | 12/2009 | Richeux | 89/37.07 |
| 8,245,624 | B1 * | 8/2012 | Green | 89/41.15 |
| 2006/0213360 | A1 * | 9/2006 | Ravid et al. | 89/36.01 |
| 2006/0283316 | A1 * | 12/2006 | Richeux | 89/37.01 |
| 2007/0119296 | A1 | 5/2007 | Niv et al. | |
| 2009/0164045 | A1 | 6/2009 | Deguire et al. | |
| 2009/0293709 | A1 * | 12/2009 | Joynt et al. | 89/36.02 |
| 2012/0191292 | A1 * | 7/2012 | McKee et al. | 701/33.1 |

FOREIGN PATENT DOCUMENTS

| | | | |
|---|---|---|---|
| GB | 496760 | A | 6/1937 |
| GB | 596253 | A | 7/1945 |

* cited by examiner

HARMONIZED TURRET WITH MULTIPLE GIMBALED SUB-SYSTEMS

CROSS-REFERENCES TO RELATED APPLICATIONS

This application claims the benefit of U.S. Provisional Application No. 61/565,176, filed Nov. 30, 2011, and U.S. Provisional Application No. 61/565,961, filed Dec. 1, 2011, the entire contents of which are incorporated herein in their entireties for all purposes.

STATEMENT AS TO RIGHTS TO INVENTIONS MADE UNDER FEDERALLY SPONSORED RESEARCH AND DEVELOPMENT

Not Applicable

BACKGROUND

1. Field of the Art

This disclosure is generally related to machine support systems and, in particular, to turret and gimbal support systems for line-of-sight sensors and weapons on military vehicles.

2. Background

On military vehicles, whether ground-, sea-, aircraft-, or space-based, the placement and orientation of a sensor on a vehicle can be important. A warfighter's situational awareness, including that used for driving/piloting, collision avoidance, navigation, covert observation, targeting, etc. may depend upon having the best, least obstructed view. A line-of-sight sensor, which includes a sensor that requires an unobstructed line in space to what it is sensing, should not be occluded by the vehicle itself, human operators, large communication antennas, or other protrusions.

A "line-of-sight sensor" can include a millimeter wave scanner, ultraviolet sensor, optical sensor, infrared sensor, radar, lidar, laser rangefinder, or other such sensor as is known in the art.

Mounting a sensor on a vehicle so that it can be rotated 360° horizontally allows the sensor to be slewed in azimuth to look at almost any off-board location independent of the heading of the vehicle. Thus, an operator of a sensor does not need to tell the driver or pilot of the vehicle to turn the vehicle so that he or she can see a target. However, especially on surface vehicles, because of the need to mount antennas, weapons, and other sensors, a 360° rotatable sensor almost invariably is occluded by at least one protrusion from the vehicles unless the sensor is mounted higher than all other protrusions from the vehicle.

Mounting the sensor on a mast is one way of elevating the sensor above all other protrusions on a ground vehicle. However, the higher the mast, the greater the "signature," or observability of the vehicle to an enemy. Furthermore, a mast expands the size envelope of the vehicle—making it less transportable on ships and cargo aircraft. Weight is also increased when the mass of the mast is taken into consideration.

Much of the same that can be said about sensors can also be said for line-of-sight weapons. A line-of-sight weapon, which includes weapons that require a relatively unobstructed line in space to what they are shooting, should not be occluded by the vehicle itself, human operators, communication antennas, or other protrusions such as sensors.

A "line-of-sight weapon" can include a gun, directional missile or rocket launcher, grenade launcher, ultrasonic weapon, electromagnetic impulse weapon, weaponized laser, or other such weapon as is known in the art.

A weaponized laser includes a laser with sufficient power to burn or singe a target at a tactical distance (e.g., >100 kW) or lower-powered lasers that can permanently or temporarily blind humans, charge coupled device (CCD) sensors of missiles, or electronic apertures.

Mounting a weapon on a ground vehicle so that it can be rotated 360° horizontally allows the weapon to shoot at almost any off-board location independent of the heading of the vehicle. Mounting the weapon higher than any other protrusion can ensure that it is not blocked. Yet, the same problems that arise with line-of-sight sensors arise with line-of-sight weapons.

Indeed, aimable, directable, guidable, steerable, or otherwise pointable devices, such as line-of-sight sensors or weapons, share the same problem in that they all should have an unobstructed 360° around them, yet they cannot all be the highest-mounted device.

Positioning and orienting both a pointable sensor and weapon on a vehicle typically involves design trade offs. If the flexibility of 360° situational awareness with the sensor is deemed more important than the flexibility of 360° prosecution of a target, then the sensor is typically mounted higher on a ground vehicle than the weapon. The weapon is not allowed to rotate to fire at the sensor lest it shoot up the sensor. If the flexibility of 360° prosecution of a target is deemed more important than the flexibility of 360° situation awareness with the sensor, then the weapon is mounted higher. The sensor cannot look through the weapon, and the vehicle driver must be cognizant to position the vehicle so that a target can be viewed by the sensor.

To alleviate this problem, more sensors or weapons can be used. For example, fore and aft sensors can be mounted lower than a central pylon for a weapon. The fore and aft sensors fill in the view where the other sensor(s) would be occluded by the pylon.

As sensors become less expensive, the alternative option of having multiple sensors is becoming more viable. However, having multiple sensors is usually more costly, complicated, and heavy than having just one sensor. This can be especially true in situations where the 360° slewing of the sensor is not just provided by a single rotational point but by a gimbal that allows movement both in azimuth and elevation.

U.S. Pat. No. 8,245,624 to Green discloses two weapons mounted to the same rotatable turret. Like a World War II vintage battleship turrets housing multiple guns, the '624 patent discloses a .50 caliber M2HB and a 40 mm MK 19 automatic grenade launcher that are aimed by the turret at the same offboard target. This allows the two weapons to rotate to shoot a target but not interfere with each other's line of bore. Yet, this solution does not solve the problem of having a sensor mast mounted nearby that must be avoided.

There is a need in the art for more flexible weapon and sensor mounting systems.

SUMMARY

In general, a novel mounting configuration of multiple slewable pointable devices, such as line-of-sight sensors and weapons, is described. One such example is a gimbaled line-of-sight sensor, which itself can rotate 360°, and a gimbaled gun, which itself can rotate 360°, both mounted on a turret platform that rotates 360°. The gimbals of the sensor and weapon are mounted across from each other, opposite the central pivot point of the rotating platform. In operation, if the weapon is in the way of the sensor's line of sight to an off-board target, then the turret is rotated so that the sensor moves out from behind the weapon (and the weapon moves out from front of the sensor). Conversely, if a situation occurs in which the sensor is in the way of the weapon's line of fire to the target, then the turret is rotated so that the weapon moves out from behind the sensor (and the sensor moves out from front of the weapon). In development, this has been informally called a "lazy Susan design."

This design can be utilized with pointable components that require 360 degree unobstructed, line-of-sight capability without any "dead zones." For example, radars, lasers, and rocket-based weapon systems can be used together. Two sensors can be used together, or two weapons can be used together.

In other embodiments, three or more line-of-sight devices can be used together. For example, a gimbaled machine gun, grenade launcher, and laser can be mounted to the same turret. The desired weapon can be slewed to the 'front,' toward the target.

Some embodiments of the present application are related to a turret apparatus. The apparatus includes a turret having a rotatable platform and a rotation axis, a first swivel assembly mounted to a first portion of the rotatable platform, a rotation axis of the first swivel assembly offset from the turret rotation axis and having an axis component parallel to the turret rotation axis, a second swivel assembly mounted to a second portion of the rotatable platform, a rotation axis of the second swivel assembly offset from the turret rotation axis and having an axis component parallel to the turret rotation axis, a first pointable device steerable by the first swivel assembly, and a second pointable device steerable by the second swivel assembly.

A control system can be operatively coupled with the turret, the control system configured with instructions to automatically rotate the turret in order to avoid one of the pointable devices from interfering with a line of sight or line of bore to an off-board location from the other pointable device. The first and second swivel assemblies can each comprise a gimbal having at least two axes of rotation.

Some embodiments are related to a tether apparatus for an aerostat or other tetherable object. The apparatus includes a turret having a rotatable platform and a rotation axis, a swivel assembly mounted to a first portion of the rotatable platform, a rotation axis of the first swivel assembly offset from the turret rotation axis and having an axis component parallel to the turret rotation axis, a tether assembly mounted to a second portion of the rotatable platform, a pointable device steerable by the swivel assembly, and a control system operatively coupled with the turret, the control system configured with instructions to automatically rotate the turret in order to avoid the tether assembly from interfering with a line of sight or line of bore to an off-board location from the pointable device These and other embodiments of the technology are described in further detail below.

DETAILED DESCRIPTION

A turntable with two or more fully rotatable (or gimbaled) line-of-sight, pointable devices mounted thereon is presented. The pointable devices can include sensors, weapons, or a combination thereof. The underlying (or overlying) turntable can be rotated so that one device does not occlude the line of sight of another device. For example, a sensor/gun combination can be rotated so that the sensor is not occluded by the gun and the gun does not have to shoot through the sensor.

Many embodiments have technical advantages over the prior art. Both a weapon system and a sensor can have 360° continuous rotation. "No fire zones" are eliminated for weapons, and there are no sensor sight restrictions. In legacy military vehicles, an existing turret can be retained while adding additional weapons and sensors that do not occlude one another's sight. Adding a rotating platform to the outside of a legacy vehicle can prevent design intrusion into the interior of the vehicle. The deck need not be modified, and whip antennas do not need to be relocated. The design can be scalable. On the turret can be mounted small, gimbaled sensors, such as those on unmanned aerial vehicles, or large, individually turreted guns such as those on battleships (i.e., turret-on-turret).

Masted systems have drawbacks in that they sometimes lack 'on the move capability' and require an increased Space Weight and Power (SWaP) footprint. A mast can add weight and signature to a vehicle. Some embodiments of the present application allow a gun and sensor to be used by operators inside while a vehicle is moving.

In an embodiment, a gun can be positioned so as to minimize the effect of its recoil and blast on sensitive optics of the sensor. For example, if the breech or muzzle of a gun is known to discharge more fire and smoke on its right side than on its left side, the sensor can be positioned so that it is on the left side of the gun when the gun is fired. As another example, if wind is blowing from the left, then the sensor can be positioned to the left in order to be upwind of smoke and sparks from the gun. Reflections from the sun or other lights can be minimized by rotating the gun so that its surfaces avoid grazing angles between the sensor and sun.

A "gimbal" includes a turntable, revolvable platform, lazy Susan, or other swivel assembly with rotatable elements for pointing. It can include one, two, three, or more degrees of freedom, such as those for pitch, yaw, and roll.

Figure 1A:
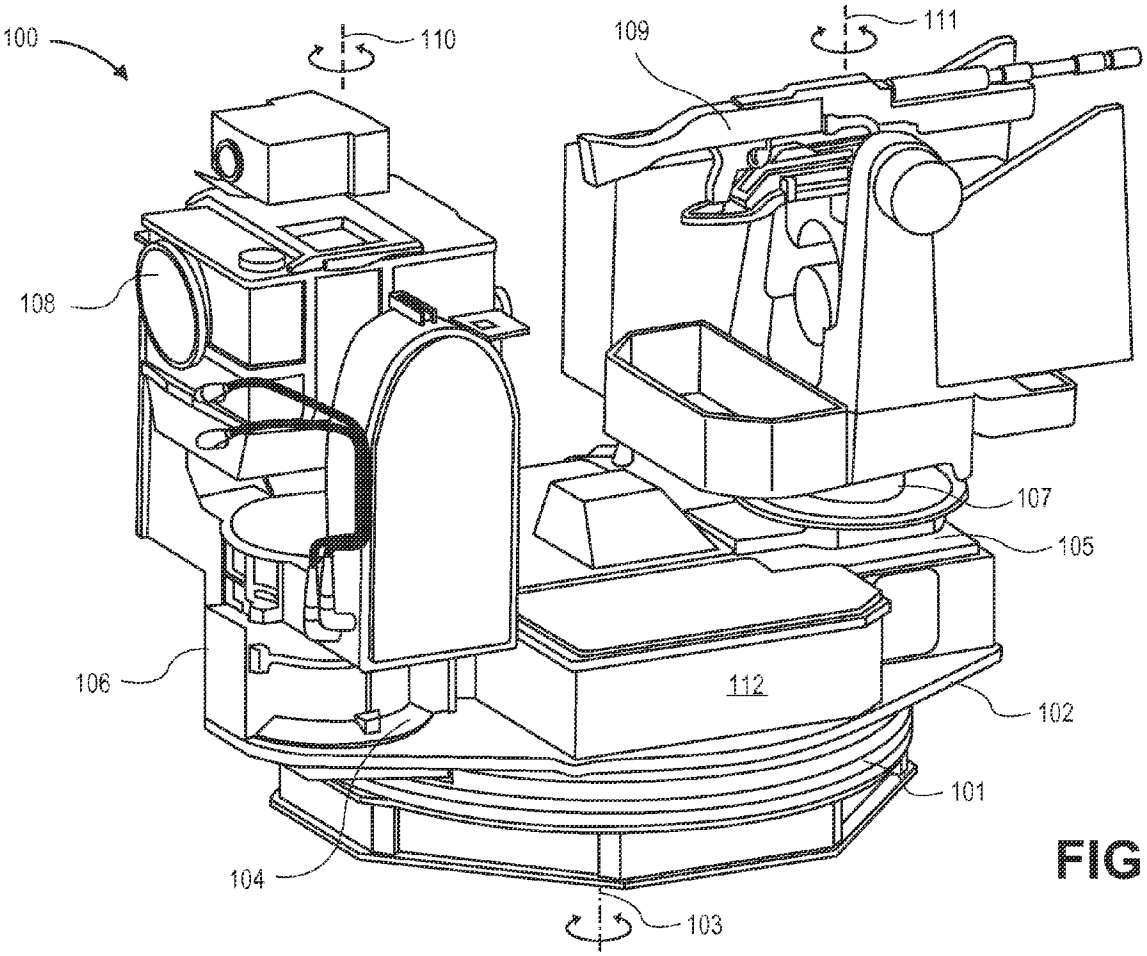
FIG. 1A is a perspective view of a turret with a gimbaled electro-optical sensor and gimbaled gun in accordance with an embodiment.
Figure 1B:
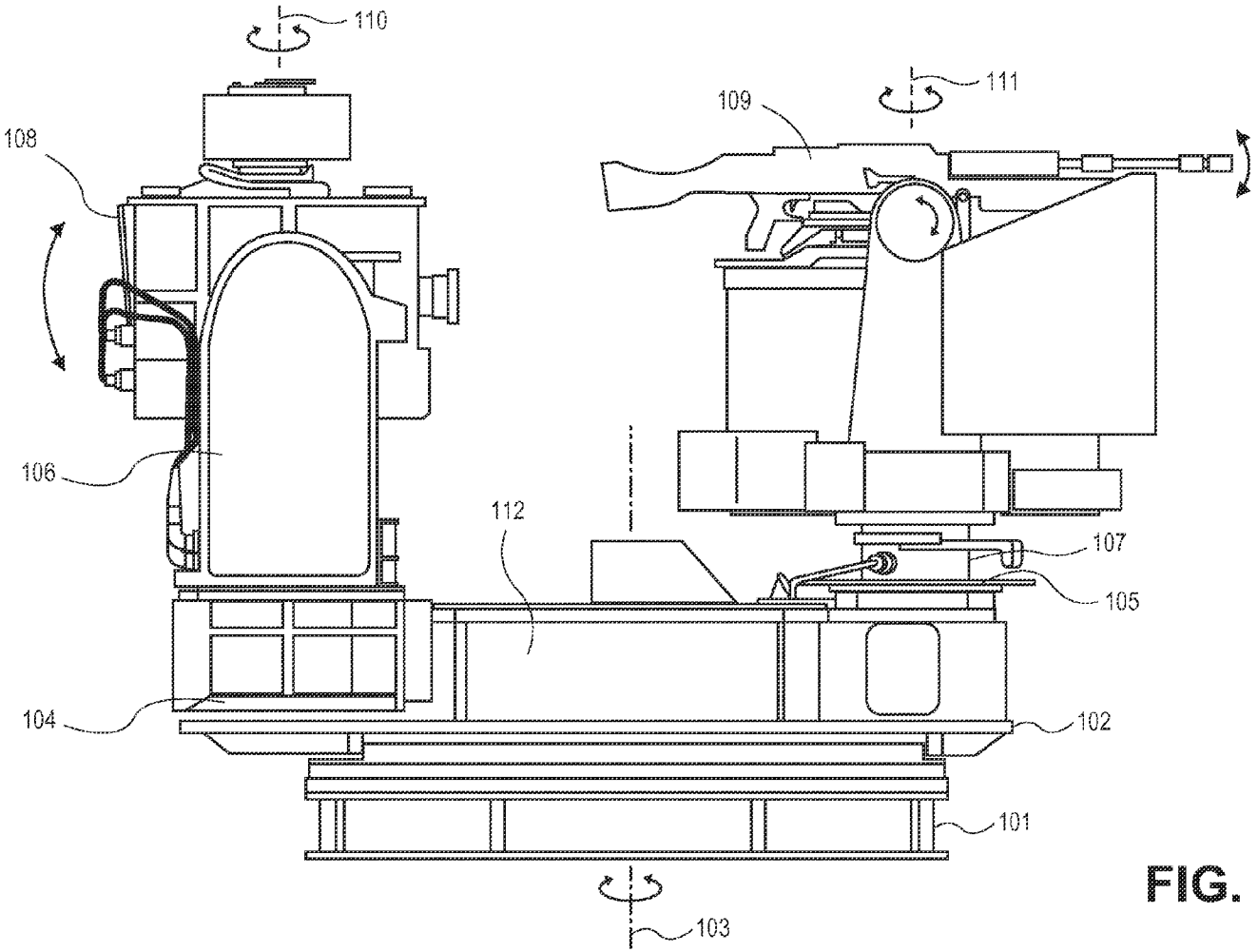
FIG. 1B is an elevation view of the assembly of FIG. 1A.

FIGS. 1A-1B depict a turret with a gimbaled electro-optical sensor and gimbaled gun in accordance with an embodiment.

In assembly 100, turret 101 rotates platform 102. The rotation of turret 101 is controlled by control system 112.

Fire Support Sensor System (FS3) sensor 108 is mounted to a Common Remote Stabilized Sensor System (CRS3) gimbal 106, which allows for 360° rotation around axis 110. CRS3 gimbal 106 is mounted off-center from rotational axis 103 of rotatable turret 101 at position 104.

Remote Weapon System (RWS) weapon 109 is mounted off-center from rotational axis 103 at position 105. RWS weapon 109 includes its own gimbal 107 that allows it to be slewed independently around axis 111.

FS3 sensor 108 and RWS weapon 109 are shown mounted more-or-less opposite one another on the rotatable platform of the turret. That is, they are both along a radial line passing through center of rotation 103 of the turret, but one device is on one side of the center of rotation and the other device is on the other side of the center of rotation. So that the center of gravity of the entire assembly is along turret rotation axis 103, heavier RWS weapon 109 is closer to the center than sensor 108.

Azimuth axis 111 of RWS weapon 109 is located slightly to the side of the radial line to optimally balance RWS weapon 109 between situations in which it has full and empty bullet magazines, which are side mounted.

Alternate embodiments may position devices on the same side of the rotating platform or at oblique angles with respect to a centerline. For example, devices may not be generally aligned along a centerline through the point of rotation of the turret platform. Such designs may be for weight, size, heat, or other constraints.

Between FS3 sensor 108 and RWS weapon 109 are removable covers for an inertial navigation unit (INU), a Turret Drive Assembly (TDA), and a RWS Main Processing Unit (MPU). The removable covers also house control system 112.

In some embodiments, control system 112 may be operatively unconnected from gimbals 106 and 107. In other embodiments, control system 112 may receive angle data from gimbals 106 and 107 in order to determine their positions. With input of the gimbal angular positions, the control system can automatically rotate the turret in order to avoid one of the pointable devices from interfering with a line of sight or line of bore to an off-board location from the other device. For example, if gimbal 106 indicates that FS3 sensor 108 is spun to look toward the turret rotation axis 103 (and thus through RWS weapon 109), then control system 112 can rotate turret platform 102 so that RWS weapon 109 is out of the way. Gimbal 106, which inertially stabilizes FS3 sensor 108 so that it continues to point in the same direction in space, compensates for the turret's rotation by rotating in the opposite direction.

In other embodiments, control system 112 may send a command to gimbal 106 in order to automatically rotate gimbal 106 in the opposite direction to compensate for turret 101's rotation. Either way, the automatic compensation (by gimbal 106 itself or by commands from control system 112 to gimbal 106) can assist a human operator in maintaining a clear field of view for FS3 sensor 108.

The turret can be configured to automatically slew the gun downwind of the sensor in order to prevent smoke from the gun from drifting into the view of the sensor's optics. The turret can be configured to align the gun to the right or left of the sensor to whichever side of the gun has less blast and/or muzzle flash.

The turret can automatically slew the gun's gimbal to the direction in which the gun is pointed in order to minimize recoil forces on the turret's motor. The sensor, which is in turn slewed directly behind the gun, is thus more protected by the gun's armor from incoming fire, damage of ejecting ammunition shells, and gun blast.

The control system can rotate the turret in one direction while rotating the sensor and/or weapon in an opposite direction in order to compensate for the turret's movement. At an infinite distance to a target, the rotations are exactly opposite. At very close distances, there are angles in which a sensor and/or weapon in the back will rotate in the same direction as the turret in order to remain pointed at a target off-board the vehicle. Between these two extremes, the sensor and weapon generally rotate in an opposite direction from the rotation of the turret in order to remain pointed at the off-board target or maintain stabilization with respect to terrain.

"Automatically rotating" includes rotating without direct human intervention at the time of the rotation or as otherwise known in the art.

An "off-board location" includes a location that is not on the turret, a vehicle upon which the turret is mounted, or as otherwise known in the art.

Figure 2:
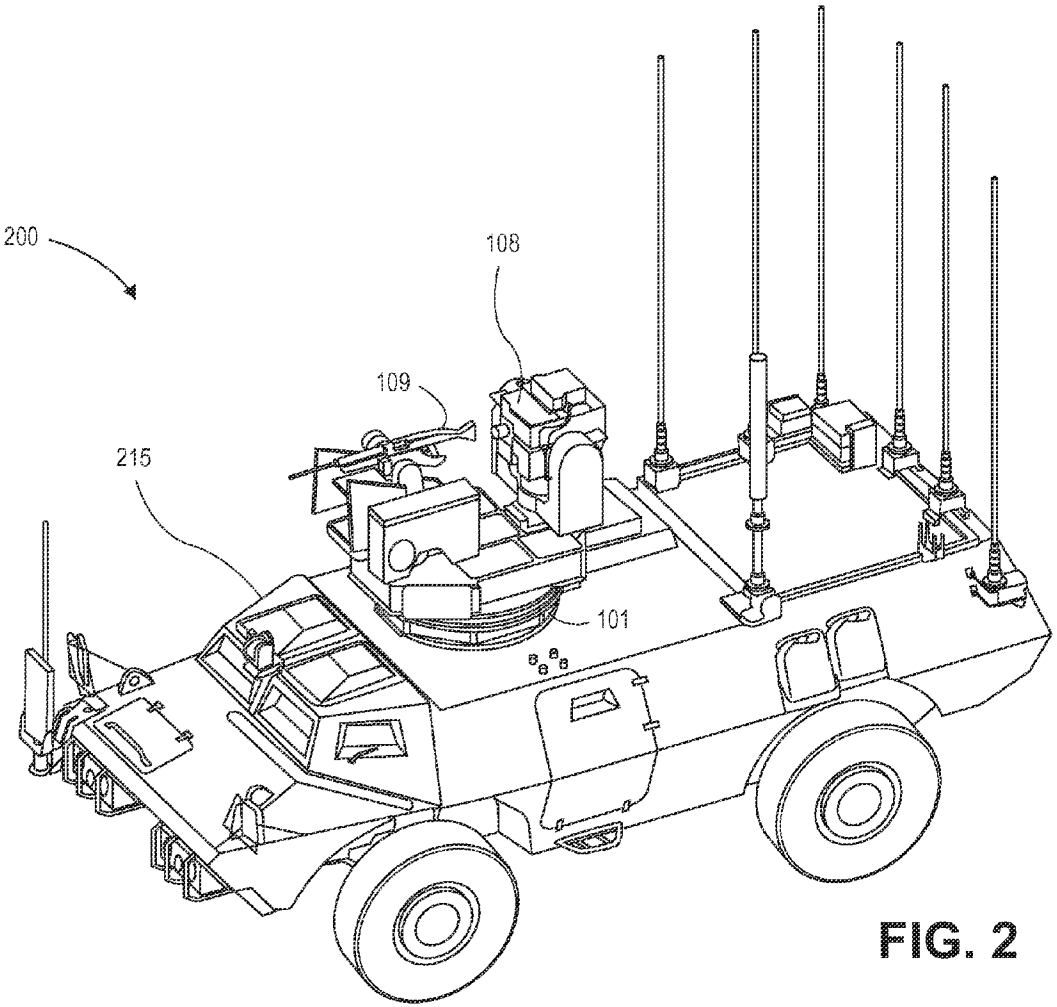
FIG. 2 depicts the turret of FIG. 1 mounted on an armored ground vehicle.

FIG. 2 depicts the apparatus of FIG. 1 mounted on an M1200 "Armored Knight" Armored Security Vehicle (ASV). System 200 includes turret 101, with sensor 108 and weapon 109, mounted on top of armored vehicle 215. A single human operator can control both sensor 108 and weapon 109, or multiple human operators can individually control sensor 108 or weapon 109. With the rotating turret, neither operator interferes with the field of view or line-of-bore of the other operator, such that they can work independently. This can be critical in fast-paced wartime situations in which the RWS operator must suppress a nearby enemy while the FS3 sensor operator scans for wider threats. This can also be helpful with geographically remote operators, such as those back at an encampment, that wish to survey a target with the sensor without hindering tactical operations by the local crew.

CRS3 FS3 sensor 108 on its stabilized sensor mount (SSM) and RWS gun 109 can both be aimed by crew in the protected hull of vehicle 215. In an embodiment, both the sensor and gun have independent hand controllers. The CRS3 is controlled by a hand control unit (HCU) with reference to a targeting display (TD). The RWS has its own control grip with reference to a Display Control Panel (DCP). The FS3 sensor on the CRS3 gimbal can be used to zoom in and positively identify a target to comply with current rules of engagement, while electro-optics on the RWS gun can be used for coarse and fine aiming. In some embodiments, video images from the sensor and electro-optics of the gun can be overlaid on the same display.

A tall Counter Remote Control Improvised Explosive Device (RCIED) Electronic Warfare (CREW) system Spiral II (CREW II) antenna and various whip antennas are mounted on the rear of the vehicle, aft of the turret system. Although the antennas are taller than the sensor and gun system, their narrow girth presents a small area in which one cannot see or shoot. Because they are so narrow and close to the sensor and gun system with respect to the diameter of the turret, a rotation of the turret may be able to move the gun or sensor's line of sight from intersecting with a blocking antenna.

Mastless, low-profile turret 101 adds little height to the sensor and weapon system. A minimal height is desired so that the system will fit into a C-130 transport aircraft without having to remove the sensor and gun sub-systems.

Figure 3:
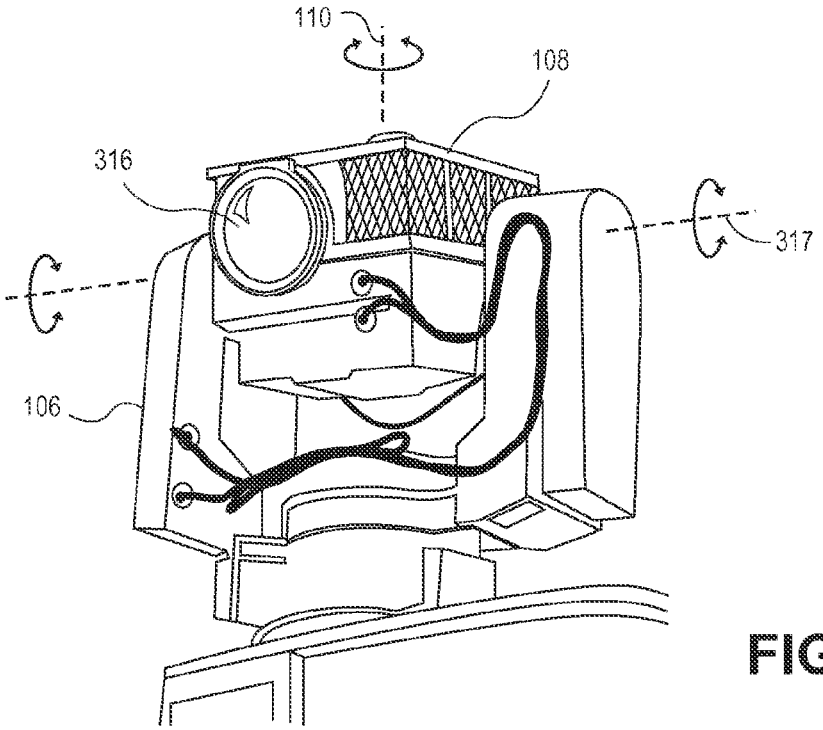
FIG. 3 illustrates a gimbaled electro-optical sensor in accordance with an embodiment.

FIG. 3 illustrates a gimbaled electro-optical FS3 sensor in accordance with an embodiment. The hardened gimbal mount provides 360° of continuous coverage as well as suitable elevation coverage. The gimbal is controlled by remote control using a yoke hand controller (HC). Video is supplied to the crew below. FS3 sensor 108 can be rotated by pan and tilt gimbal 106 in azimuth around axis 110 and in elevation around axis 317 in order to point optics 316 toward a target.

Figure 4:
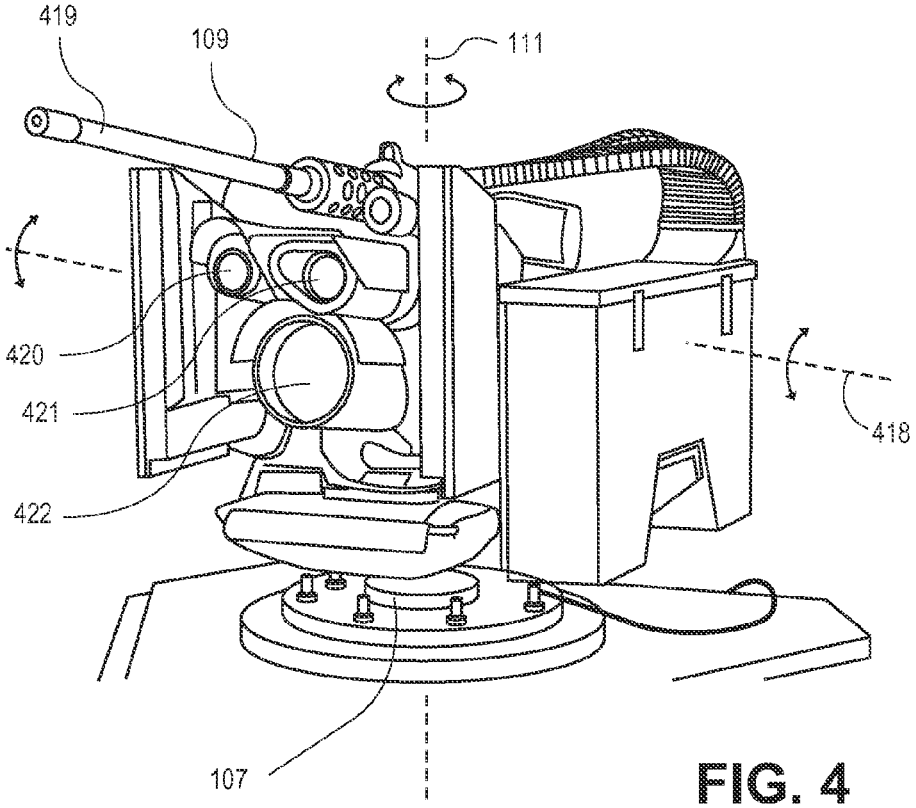
FIG. 4 illustrates a gimbaled machine gun in accordance with an embodiment.

FIG. 4 illustrates a gimbaled RWS machine gun in accordance with an embodiment. Exemplary pan and tilt weapon gimbal 107, an M151 Protector Common Remotely Operated Weapon Station (CROWS) II gimbal system, manufactured by Kongsberg Defence & Aerospace of Kongsberg, Norway, can accommodate several types of machine guns and grenade launchers. It is gyro-stabilized and provides 360° of continuous coverage. Its sensor unit includes daylight video camera 421, thermal imager 422, and laser rangefinder 420. The CROWS II weapon is one of many that can be mounted to the turret system. RWS gun 109 can be rotated in azimuth around axis 111 and in elevation around axis 418 in order to point barrel 419 toward a target.

Figure 5:
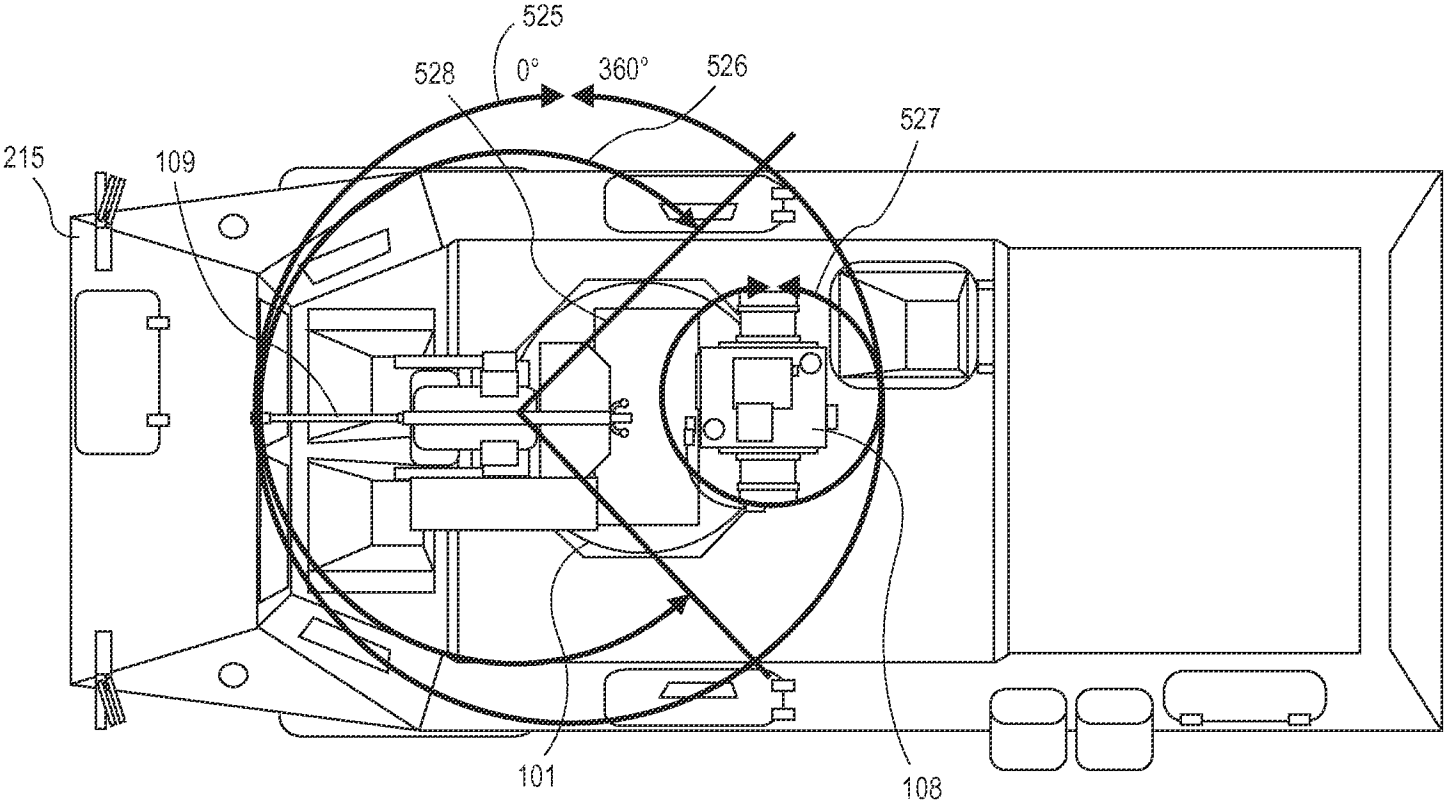
FIG. 5 is a top view of rotational degrees of freedom of an apparatus in accordance with an embodiment.

FIG. 5 is a top view of rotational degrees of freedom of an embodiment. Upon vehicle 215 is mounted turret apparatus 101. Upon turret apparatus 101 is mounted gimbaled sensor 108 and weapon 109. Sensor 108 can be freely rotated 360° as indicated by full circle 527. Weapon 109, with its long barrel, has hard stops at ±45° with respect to sensor 108 (at 0°, or horizontally right in the diagram), as indicated by ¾circle 526. RWS weapon 109 has approximately 270° of motion envelope from stop to stop. Thus, the long gun barrel cannot contact the sensor gimbal. There are 'soft' stops, using software, that prevent the gun from being rammed or driven into the hard stops at full force.

If an operator wishes to point weapon 109 between ±45° of the right in the diagram (i.e., over the back of vehicle 215), then turret 101 can be rotated 45°, 90°, 180°, or any other angle as appropriate as indicated by 360° full circle 525 so that weapon 109 is no longer hindered by the hard or soft stops. For example, if turret 101 is rotated 90°, then weapon 109 and sensor 108 are perpendicular to the rear, and both have lines of sight (or bore) to the rear of the vehicle. Other configurations from the exemplary embodiment are envisaged.

Figure 6:
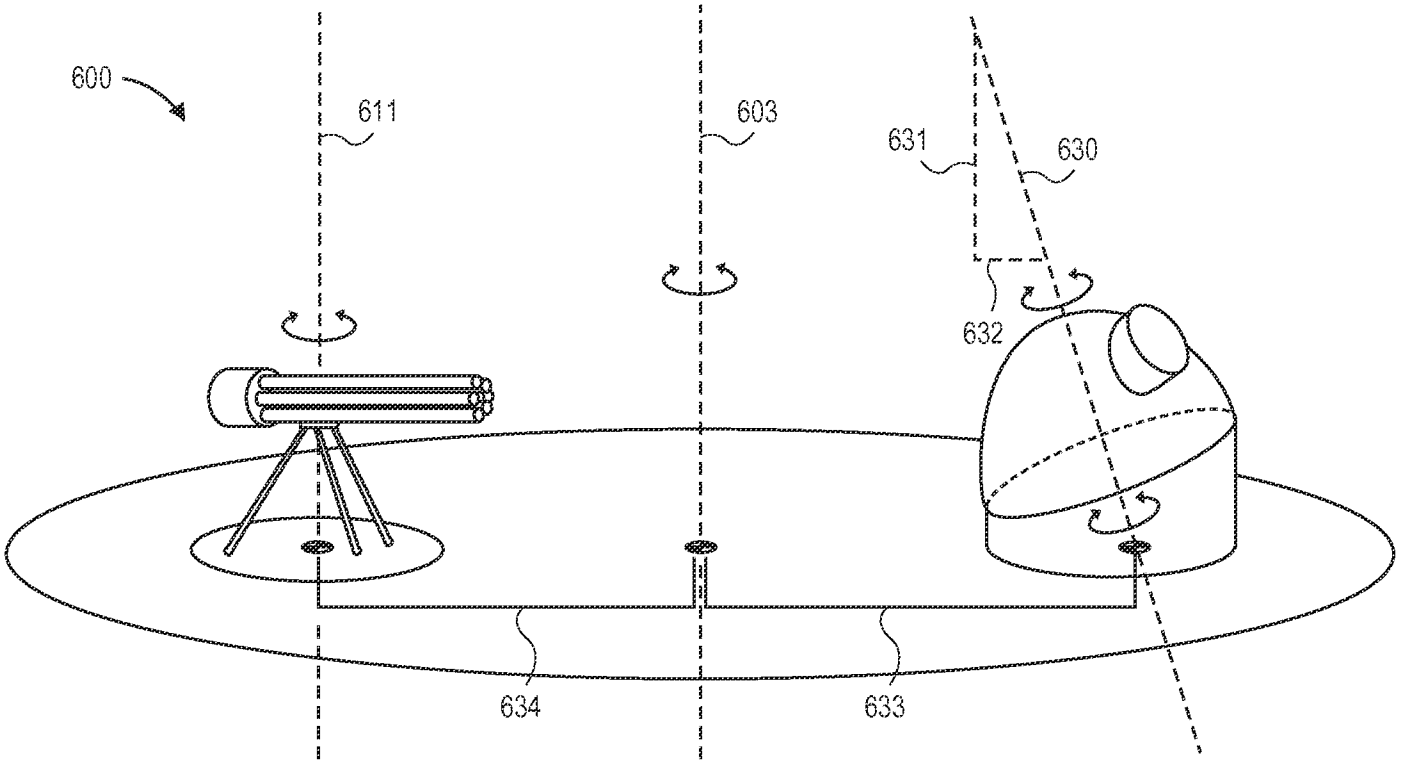
FIG. 6 illustrates rotational axis components in accordance with an embodiment.

FIG. 6 illustrates axis components in accordance with an embodiment. In assembly 600, a gun and sensor are mounted to a turret, the turret having axis of rotation 603. The gun is rotatable around its own axis 611, which is parallel to turret rotation axis 603. The gun's axis 611 is "offset" from turret rotation axis 603 by radial distance 634.

In this embodiment, the sensor is mounted so that it permanently canted inward. The sensor rotates around canted axis 630, which has axis component 631 that is parallel to turret rotation axis 603. Sensor axis 630 also has axis component 632 that is perpendicular to turret rotation axis 603. Canted turret axis 630 is offset from turret rotation axis 603 by radial distance 633, which is the distance between the points where the axes pass in the turret plane.

In some embodiments, the turret itself can be permanently tilted. In a tilted turret configuration, a short sub-system can be slewed to be higher than a tall sub-system. Conversely, a tall sub-system can be slewed so that it is even higher than it would normally be while 'hiding' the short sub-system. Slewing the tilted turret so that both sub-systems are at the same height can minimize the entire system's height for transport or reduced signature.

Figure 7:
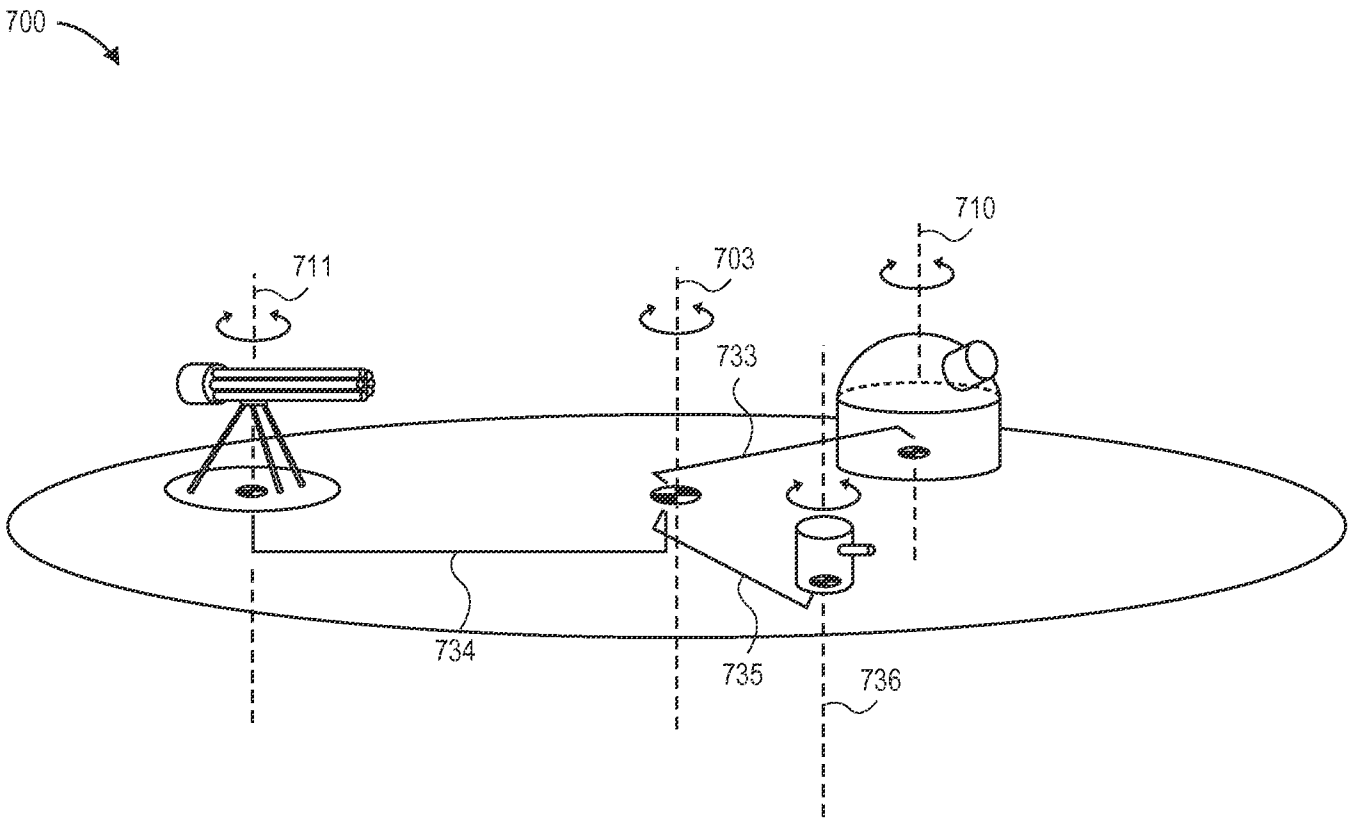
FIG. 7 illustrates three offset axes of pointable devices in accordance with an embodiment.

FIG. 7 illustrates three offset axes of pointable devices in accordance with an embodiment. In assembly 700, a gun, sensor, and laser rangefinder are mounted to a turret in a wye pattern, the turret having axis of rotation 703. Gun axis 711 is offset from turret rotation axis 703 by radial distance 734. Sensor axis 710 is offset from turret rotation axis 703 by radial distance 733. And laser rangefinder axis 736 is offset from turret rotation axis 703 by radial distance 735. Radial distances 733, 734, and 735 may be selected by center of gravity considerations. In the exemplary embodiment, the center of gravity of the entire assembly is positioned so that it is along turret axis 703.

Thus, given weights W1, W2, and W3 of the gun, sensor, and laser rangefinder sub-systems in the figure, radial distances L1, L2, and L3 (radial distances 734, 733, and 735, respectively) should be selected such that:

$$W_1L_1=W_2L_2=W_3L_3 \qquad \text{Eqn. 1:}$$

This can be expanded to configurations with any different number of sub-systems. It can also be expended to non-circular turrets, such as single bar, cross, spoked, peace-sign, or other configurations that carry the different number of sub-systems.

Figure 8:
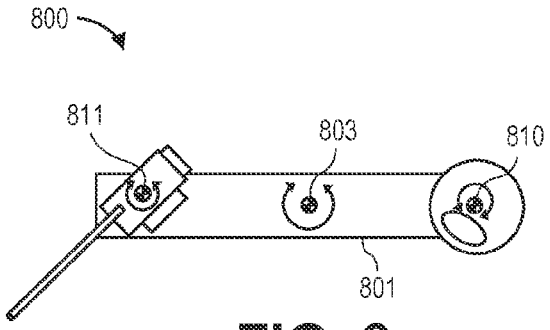
FIG. 8 illustrates a turret with a bar configuration in accordance with an embodiment.

FIG. 8 illustrates a turret with a bar configuration in accordance with an embodiment. In assembly 800, bar turret 801 rotates around axis 803. Two subsystems, which are across from one another on bar turret 801, individually rotate around respective axes 811 and 810.

Figure 9:
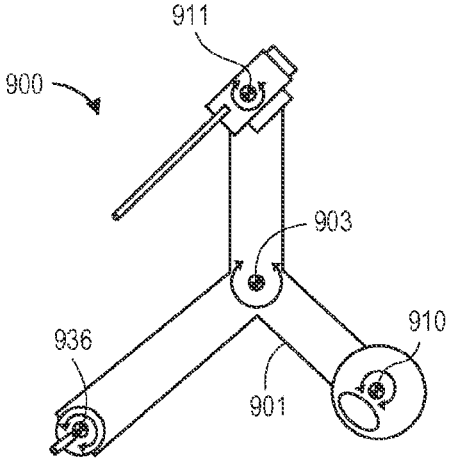
FIG. 9 illustrates a turret with a wye configuration in accordance with an embodiment.

FIG. 9 illustrates a turret with a wye configuration in accordance with an embodiment. In assembly 900, wye turret 901 rotates around axis 903. Three subsystems, which are symmetrically laid out in a "Y" configuration on wye turret 901, individually rotate around respective axes 911, 910, and 936.

Figure 10:
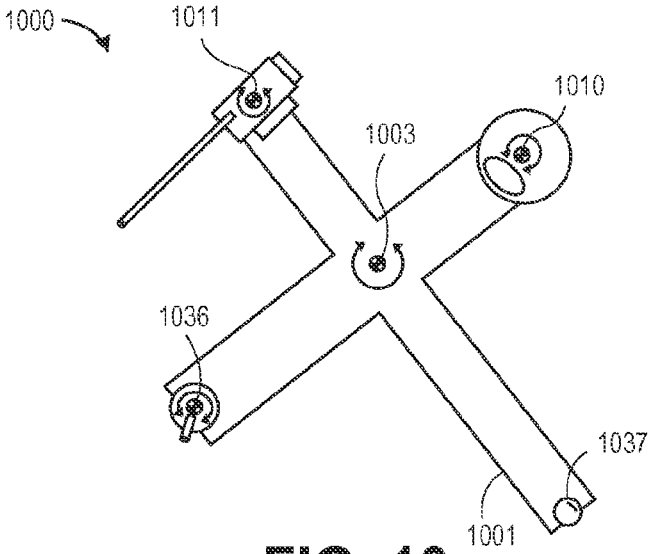
FIG. 10 illustrates a turret with a cruciform configuration in accordance with an embodiment.

FIG. 10 illustrates a turret with a cruciform configuration in accordance with an embodiment. In assembly 1000, cruciform turret 1001 rotates around axis 1003. Four subsystems, which are laid out in an "X" configuration on cruciform turret 1001, individually rotate around respective axes 1011, 1010, 1036, and 1037.

In some embodiments, the sub-system associated with axis 1037 may not rotate at all, but rather be a tall antenna, symmetrical sensor (such as an omnidirectional microphone), or tether. In some embodiments, the gimbal assembly is envisioned as being "upside-down."

Figure 11:
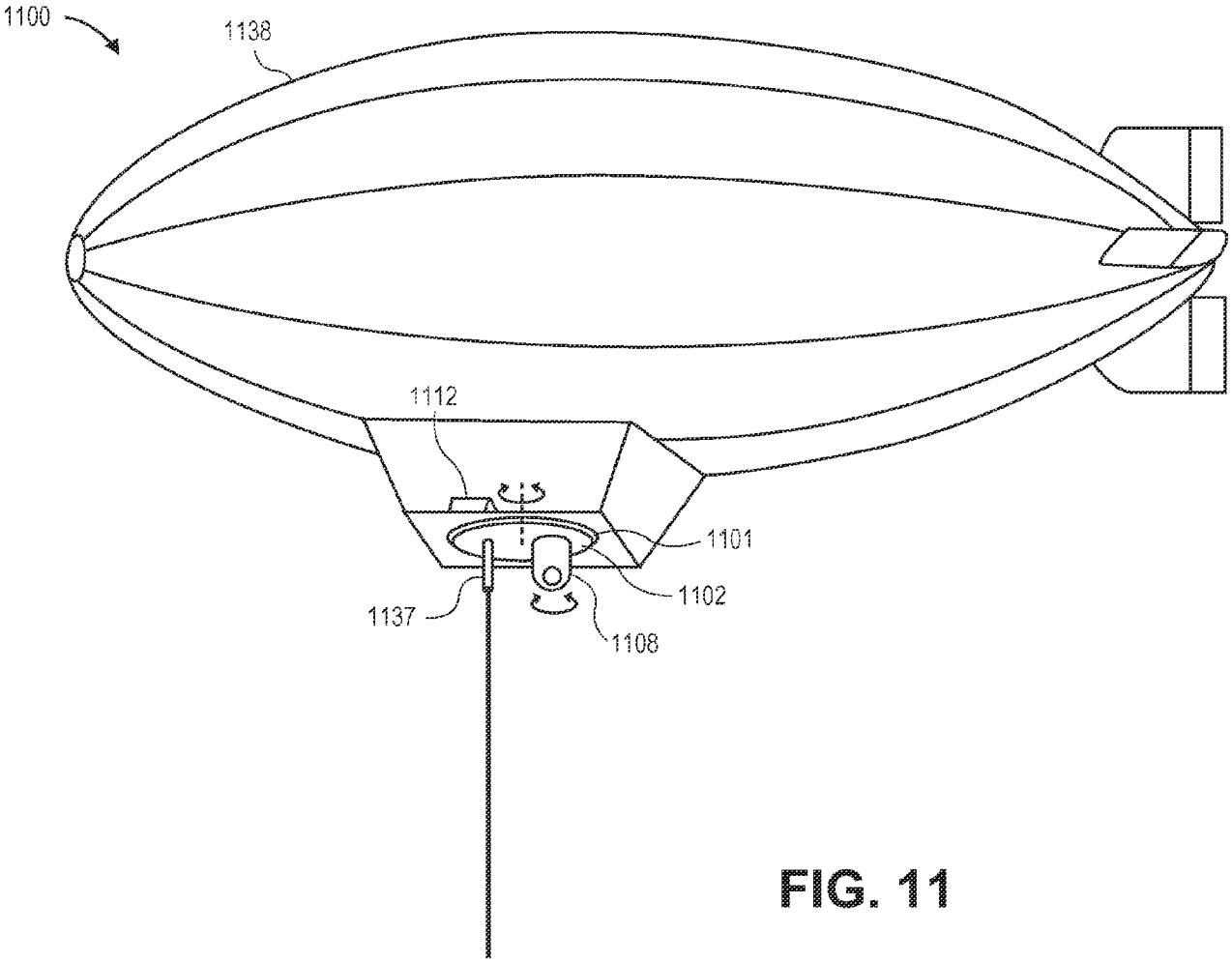
FIG. 11 illustrates a tether apparatus for an aerostat in accordance with an embodiment.

FIG. 11 illustrates a tether apparatus for an aerostat in accordance with an embodiment. System 1100 includes lighter-than air aerostat 1138 with upside-down rotating turret 1101 and platform 1102. On platform 1102 are mounted sensor 1108 and tether 1137. Tether 1137 is anchored at ground level, which can be several hundred or thousand meters below aerostat 1138.

A remote operator can use sensor 1108 to survey a border, engagement zone, or other area of interest. If sensor 1108 or aerostat 1138 turns so that tether 1137 is in the field of view of sensor 1108, control system 1112 can rotate turret platform 1102 so that tether 1137 is out of its way. Tether 1137 can be mounted at the center of rotation of platform 1102 so that loads are carried through the same place, or it can be offset if tether loads are not significant.

Rotating a tether of the way can be especially important where there is a gun or other line-of-sight weapon (instead of a sensor) that could sever the tether—and send the aerostat skyward.

Other unmanned aerial vehicle systems (UAS) can use an upside down turret. A drone aircraft can carry multiple sensors and/or weapons underneath its fuselage, scanning the horizon for missile launches or incoming threats. If a launch is detected, then a large scanning sensor can be slewed out of the way of an X-band radar tracking sensor. When the incoming missile enters the UAS' weapon engagement envelope, then the X-band tracking radar can be moved to the side and a high power, weaponized laser can be pointed at the target in order to destroy or spoof it.

Figure 12:
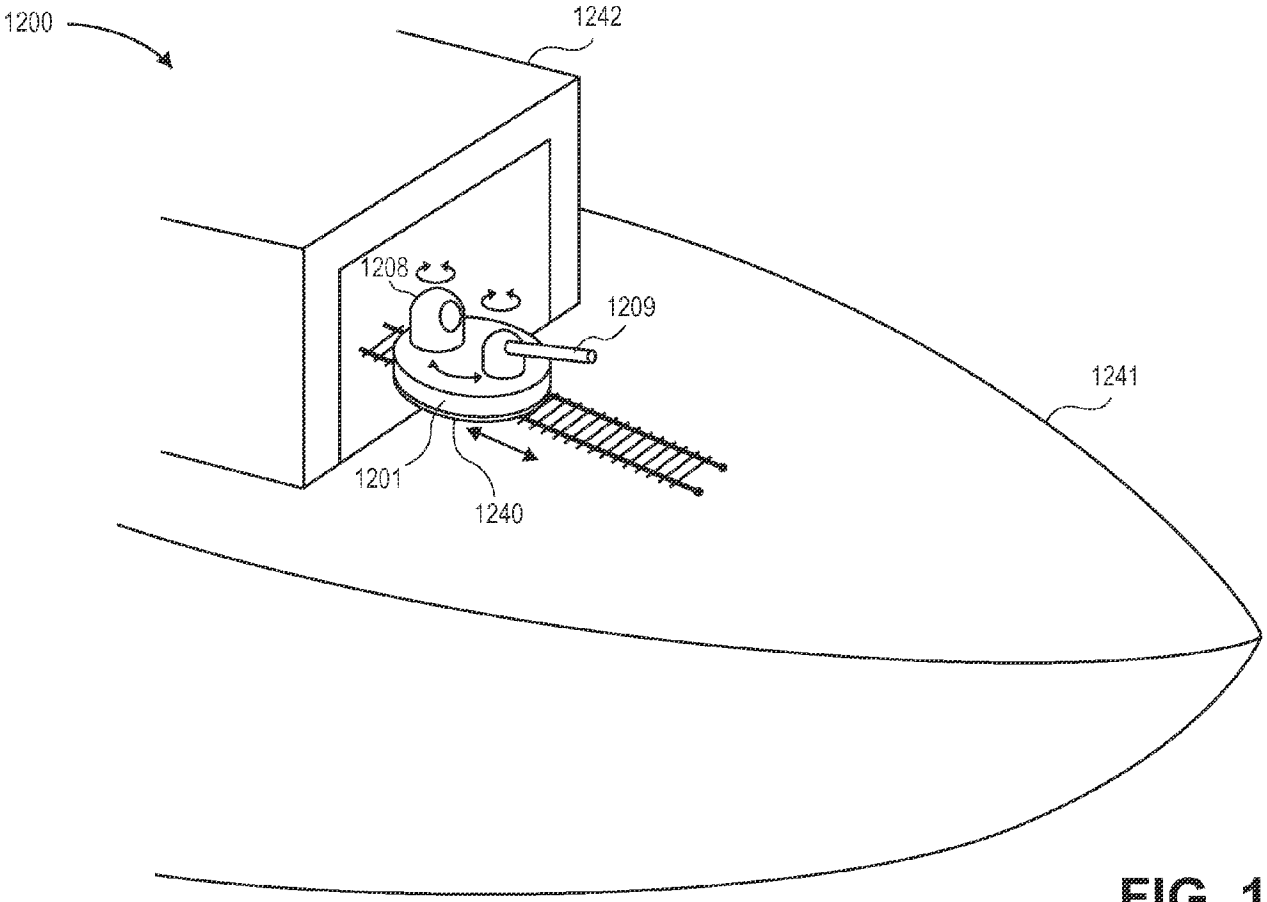
FIG. 12 illustrates a shipboard translatable turret assembly in accordance with an embodiment.

FIG. 12 illustrates a translatable turret assembly in accordance with an embodiment. In shipboard system 1200, turret 1201 is mounted on translatable dolly 1240. On turret 1201 are mounted sensor 1208 and gun 1209. Dolly 1240 can be moved out of shelter 1242 to the bow of surface ship 1241 when the sensor or gun are needed. When not required, or to protect the sensor and weapons from the elements or incoming fire, dolly 1240 with turret 1201 can be moved back into shelter 1242.

Shipboard applications can use heave actuators on its turret. By displacing up and down, a turret can compensate for up-and-down movement of the ship in high seas. Sub-system heave actuators may be used instead or in addition. The height of the vertical displacement is not an issue for blocking other sub-systems when the turret can move a high sub-system out of the way of another sub-system by simply rotating the turret.

Although the exemplary embodiments featured weapon and military vehicles, the teachings of this disclosure extend to non-military uses. For example, filmmakers can use such turret systems to mount movie cameras, spot lights, and other pointable devices. A light can be slewed out of the way of a camera during a 360° action shot while keeping the camera focused on the subjects. In other embodiments, multiple satellite dishes and other antennas can be mounted to a common turret in order to keep them out of the way of one another on planetary exploration rovers. A turret, with a single rotational degree of freedom, can be scaled up to very heavy objects, such as giant astronomical telescopes, and scaled down to very small objects, such as chip cameras and lidars on UAS.

It should be understood that some of the present technology as described above can be implemented in the form of control logic using computer software in a modular or integrated manner. Based on the disclosure and teachings provided herein, a person of ordinary skill in the art will know and appreciate other ways and/or methods to implement the present technology using hardware and a combination of hardware and software.

Any of the software components or functions described in this application, may be implemented as software code to be executed by a processor using any suitable computer language such as, for example, Java, C++ or Perl using, for example, conventional or object-oriented techniques. The software code may be stored as a series of instructions, or commands on a computer readable medium, such as a random access memory (RAM), a read only memory (ROM), a magnetic medium such as a hard-drive or a floppy disk, or an optical medium such as a CD-ROM. Any such computer readable medium may reside on or within a single computational apparatus, and may be present on or within different computational apparatuses within a system or network.

The above description is illustrative and is not restrictive. Many variations of the technology will become apparent to those skilled in the art upon review of the disclosure. The scope of the technology should, therefore, be determined not with reference to the above description, but instead should be determined with reference to the pending claims along with their full scope or equivalents.

One or more features from any embodiment may be combined with one or more features of any other embodiment without departing from the scope of the technology.

A recitation of "a", "an" or "the" is intended to mean "one or more" unless specifically indicated to the contrary.

What is claimed is:

1. A turret apparatus, the apparatus comprising:

a turret having a rotatable platform and a rotation axis;

a first swivel assembly mounted to a first portion of the rotatable platform, a rotation axis of the first swivel assembly offset from the turret rotation axis and having a component parallel to the turret rotation axis;

a second swivel assembly mounted to a second portion of the rotatable platform, a rotation axis of the second swivel assembly offset from the turret rotation axis and having a component parallel to the turret rotation axis;

a first pointable device steerable by the first swivel assembly, wherein the first pointable device includes a sensor; and a second pointable device steerable by the second swivel assembly.

2. A turret apparatus, the apparatus comprising:

a turret having a rotatable platform and a rotation axis;

a first swivel assembly mounted to a first portion of the rotatable platform, a rotation axis of the first swivel assembly offset from the turret rotation axis and having a component parallel to the turret rotation axis;

a second swivel assembly mounted to a second portion of the rotatable platform, a rotation axis of the second swivel assembly offset from the turret rotation axis and having a component parallel to the turret rotation axis;

a first pointable device steerable by the first swivel assembly;

a second pointable device steerable by the second swivel assembly; and a control system operatively coupled with the turret, the control system configured with instructions to automatically rotate the turret in order to avoid one of the pointable devices from interfering with a line of sight or line of bore to an off-board location from the other pointable device.

3. The apparatus of claim 2 wherein at least one of the pointable devices is configured for steering by an operator, the control system thereby assisting the operator in maintaining a clear field of view for the at least one pointable device.

4. The apparatus of claim 2 wherein the control system is operatively connected with at least one of the swivel assemblies, the control system configured with instructions to steer the at least one of the swivel assemblies in an opposite direction from a rotation of the turret to compensate for the turret rotation.

5. A turret apparatus, the apparatus comprising:

a turret having a rotatable platform and a rotation axis;

a first swivel assembly mounted to a first portion of the rotatable platform, a rotation axis of the first swivel assembly offset from the turret rotation axis and having a component parallel to the turret rotation axis;

a second swivel assembly mounted to a second portion of the rotatable platform, a rotation axis of the second swivel assembly offset from the turret rotation axis and having a component parallel to the turret rotation axis;

a first pointable device steerable by the first swivel assembly; and a second pointable device steerable by the second swivel assembly, wherein the first and second swivel assemblies each comprise a gimbal having at least two axes of rotation.

6. The apparatus of claim 1 wherein the turret and first swivel assembly are each rotatable 360° in yaw.

7. The apparatus of claim 1 wherein the turret rotation axis and axes of rotation of the first and second swivel assemblies are parallel to one another.

8. The apparatus of claim 1 wherein the sensor is selected from the group consisting of a millimeter wave scanner, ultraviolet sensor, optical sensor, infrared sensor, radar, lidar, and laser rangefinder.

9. The apparatus of claim 1 wherein the second pointable device includes a weapon.

10. The apparatus of claim 9 wherein the weapon is selected from the group consisting of a gun, directional missile or rocket launcher, grenade launcher, microwave weapon, ultrasonic weapon, electromagnetic impulse weapon, and weaponized laser.

11. The apparatus of claim 1 wherein the second portion of the platform is mounted opposite the turret rotation axis from the first portion of the platform.

12. A vehicle comprising the apparatus of claim 1.

13. The vehicle of claim 12 wherein the vehicle is selected from the group consisting of a wheeled armored vehicle, tracked vehicle, surface ship, helicopter, lighter-than-air aircraft, and airplane.

14. The vehicle of claim 12 wherein the first and second swivel assemblies each comprise a gimbal having at least two axes of rotation, the gimbals each having an independent stabilization system configured with instructions to stabilize yaw and pitch with respect to terrain while the vehicle moves, thereby providing on-the-move capability.

15. The vehicle of claim 12 wherein at least one of the pointable devices is configured to be operated by a remote operator outside of the vehicle.

16. The apparatus of claim 1 wherein the first and second pointable devices are configured to be operated by different operators.

17. The apparatus of claim 1 further comprising:

a third swivel assembly mounted to a third portion of the rotatable platform, a rotation axis of the third swivel assembly having a component parallel to the turret rotation axis; and a third pointable device steerable by the third swivel assembly.

18. The apparatus of claim 2 wherein the turret and first swivel assembly are each rotatable 360° in yaw.

19. The apparatus of claim 2 wherein the turret rotation axis and axes of rotation of the first and second swivel assemblies are parallel to one another.

20. The apparatus of claim 5 wherein the turret and first swivel assembly are each rotatable 360° in yaw.

* * * * *